US011353041B2

(12) United States Patent
Lin et al.

(10) Patent No.: US 11,353,041 B2
(45) Date of Patent: Jun. 7, 2022

(54) BLADE AND FAN STRUCTURE

(71) Applicant: Acer Incorporated, New Taipei (TW)

(72) Inventors: Yu-Ming Lin, New Taipei (TW); Wen-Neng Liao, New Taipei (TW); Cheng-Wen Hsieh, New Taipei (TW); Jau-Han Ke, New Taipei (TW); Shun-Ta Yu, New Taipei (TW)

(73) Assignee: Acer Incorporated, New Taipei (TW)

( * ) Notice: Subject to any disclaimer, the term of this patent is extended or adjusted under 35 U.S.C. 154(b) by 250 days.

(21) Appl. No.: 16/703,794

(22) Filed: Dec. 4, 2019

(65) Prior Publication Data

US 2020/0182258 A1 Jun. 11, 2020

(30) Foreign Application Priority Data

Dec. 7, 2018 (TW) ..... 107144119

(51) Int. Cl.
*F04D 29/42* (2006.01)
*F04D 29/28* (2006.01)

(52) U.S. Cl.
CPC ..... *F04D 29/4226* (2013.01); *F04D 29/281* (2013.01); *F04D 29/282* (2013.01); *F05D 2240/304* (2013.01); *F05D 2240/307* (2013.01)

(58) Field of Classification Search
CPC .... F04D 29/281; F04D 29/282; F04D 29/384; F04D 29/30; F04D 29/305; F04D 29/2216; F04D 29/242; F04D 29/247
See application file for complete search history.

(56) References Cited

U.S. PATENT DOCUMENTS

| | | | | |
|---|---|---|---|---|
| 2007/0065279 | A1 | 3/2007 | Lin et al. | |
| 2014/0079541 | A1* | 3/2014 | Chiou | F04D 29/4226 415/206 |
| 2018/0202456 | A1* | 7/2018 | Tamaoka | F04D 29/4226 |
| 2019/0072112 | A1* | 3/2019 | Lin | F04D 29/281 |

FOREIGN PATENT DOCUMENTS

| | | |
|---|---|---|
| CN | 1128327 | 8/1996 |
| CN | 201232660 | 5/2009 |
| CN | 103967808 | 8/2014 |
| CN | 204371773 | 6/2015 |
| CN | 204755393 | 11/2015 |
| CN | 103185039 | 11/2016 |
| CN | 207122440 | 3/2018 |
| CN | 207935120 | 10/2018 |

(Continued)

OTHER PUBLICATIONS

"Search Report of Europe Counterpart Application", dated May 4, 2020, p. 1-p. 6.

(Continued)

*Primary Examiner* — Kenneth J Hansen
(74) *Attorney, Agent, or Firm* — JCIPRNET

(57) ABSTRACT

A fan blade includes an arc-shaped body and a connecting portion. The arc-shaped body has a main portion and an end portion connected to the main portion, wherein a width of the end portion is gradually decreased in a direction away from the main portion. The connecting portion is connected to the main portion, and the end portion and the connecting portion are respectively located at two opposite sides of the main portion. A fan structure is also provided.

9 Claims, 6 Drawing Sheets

(56) References Cited

FOREIGN PATENT DOCUMENTS

| | | |
|---|---|---|
| EP | 2792886 | 10/2014 |
| JP | H10288196 | 10/1998 |
| JP | 2018115651 | 7/2018 |
| TW | 580164 | 3/2004 |
| TW | M475518 | 4/2014 |
| TW | I516683 | 1/2016 |
| TW | M526002 | 7/2016 |
| TW | I591263 | 7/2017 |
| TW | M552997 | 12/2017 |
| TW | I612223 | 1/2018 |

OTHER PUBLICATIONS

"Office Action of Europe Counterpart Application", dated Mar. 7, 2022, pp. 1-5.

* cited by examiner

BLADE AND FAN STRUCTURE

CROSS-REFERENCE TO RELATED APPLICATION

This application claims the priority benefit of Taiwan application serial no. 107144119, filed on Dec. 7, 2018. The entirety of the above-mentioned patent application is hereby incorporated by reference herein and made a part of this specification.

BACKGROUND

Technical Field

The disclosure relates to a fan blade and a fan structure, in particular, to a fan blade and a fan structure using the same.

Description of Related Art

Most of the common electronic devices, such as servers, host of personal desktop computer, all-in-one computer (AIO), notebook computer, and monitor, etc., have a built-in fan. Because of the airflow generated while the fan operates, the heat generated while the electronic devices operate is dissipated to the outside.

Currently, the fan adopts metal fan blades. In order to meet the thin design requirements, the width of the metal blade in a direction parallel to the rotation axis of the fan is continually reduced. Therefore, the length of the metal blade (also called as the arc length of the metal blade) in a direction perpendicular to the rotation axis of the fan needs being increased to maintain the flow rate while the fan operates. However, during the operation of the fan, the end portion of the excessive long metal blade hits the case because of deviation. As a result, the increment of the length of the metal fan blade (also called as arc length of the metal fan blade) along the direction perpendicular to the rotation axis of the fan is limited, so it is difficult to significantly improve the heat dissipation efficiency of the fan. Otherwise, the size of the case needs being increased so that the thin design requirements are not satisfied.

SUMMARY

The disclosure provides a fan blade and a fan structure having good heat dissipation efficiency.

A fan blade of the disclosure includes an arc-shaped body and a connecting portion. The arc-shaped body has a main portion and an end portion connected to the main portion, wherein the width of the end portion is gradually decreased in a direction away from the main portion. The connecting portion is connected to the main portion, and the end portion and the connecting portion are respectively located at two opposite sides of the main portion.

A fan structure of the disclosure includes a case, a cover, and a fan. The cover is disposed on the case. The fan is pivotally disposed inside the case and is located between the cover and the case. The fan includes a hub and a plurality of fan blades. The fan blades are arranged around the periphery of the hub. Each of the fan blades includes an arc-shaped body and a connecting portion. The arc-shaped body has a main portion and an end portion connected to the main portion, and the width of the end portion is gradually decreased in a direction away from the main portion. The connecting portion is connected to the main portion, the end portion and the connecting portion are respectively located at two opposite sides of the main portion, and the main portion is connected to the hub through the connecting portion.

Based on the above, in the fan blade adopted by the fan structure of the disclosure, the end portion opposite to the hub has a design for conflict prevention. Therefore, the end portion of the fan blade, which produces deviation, would not hit the cover and the case during the operation of the fan. As a result, the length of the fan blade (also called as arc length of the fan blade) in the direction perpendicular to the rotation axis of the fan may be increased, so as to significantly improve the heat dissipation efficiency of the fan and, at the same time, to meet the thin design requirements.

In order to make the aforementioned and other features and advantages of the disclosure more comprehensible, embodiments accompanying figures are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
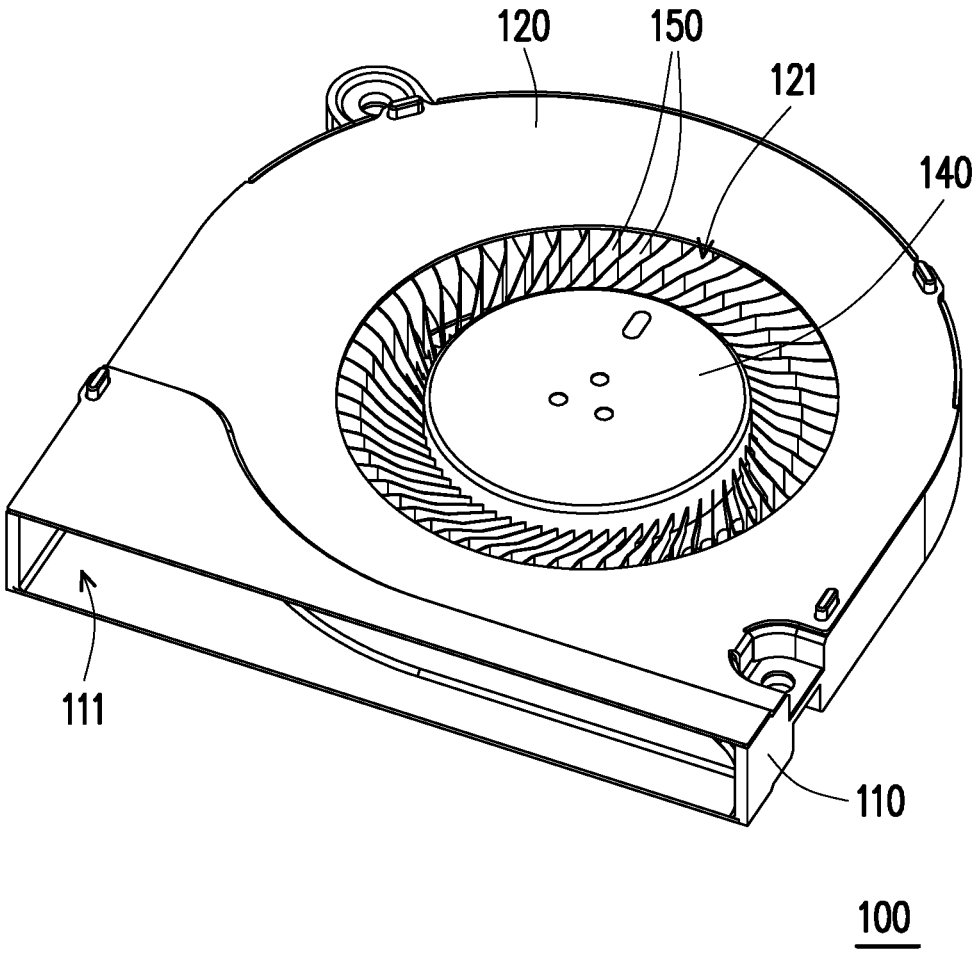
FIG. 1 is a schematic view of a fan structure according to an embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

Figure 2:
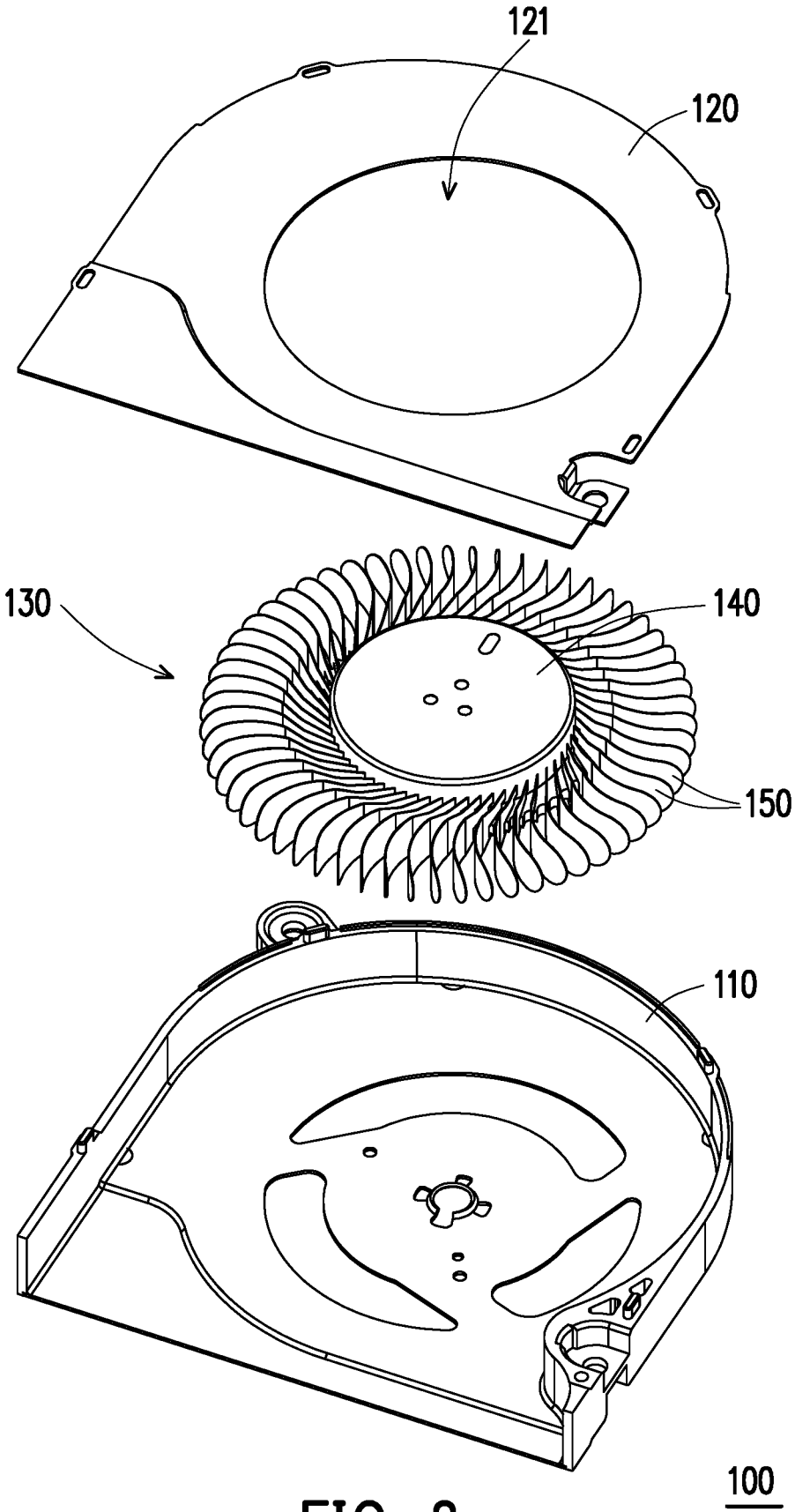
FIG. 2 is a schematic exploded view of the fan structure in FIG. 1.

FIG. 1 is a schematic view of a fan structure according to an embodiment of the disclosure. FIG. 2 is a schematic exploded view of the fan structure in FIG. 1.

Figure 3:
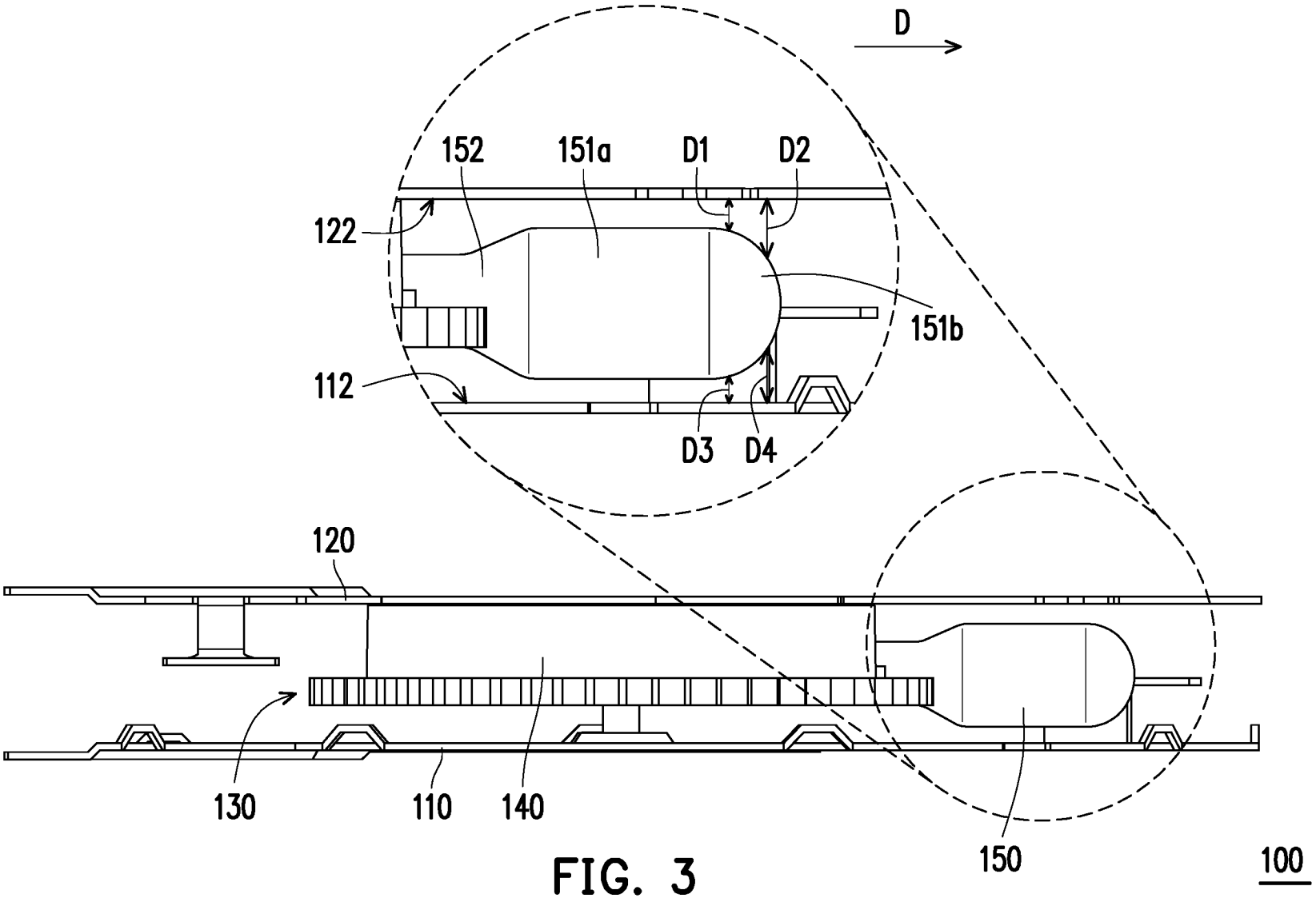
FIG. 3 is a side view of the fan structure in FIG. 1.
Figure 4:
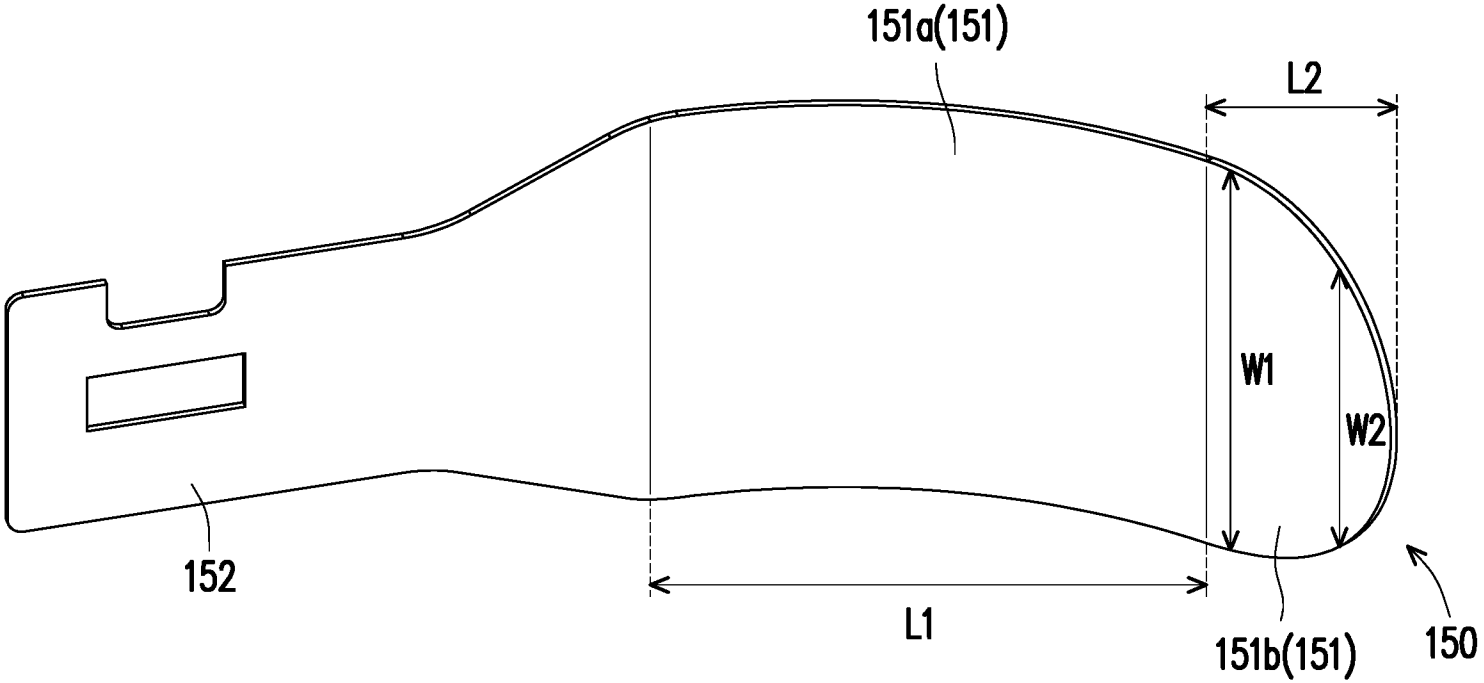
FIG. 4 is a schematic view illustrating structure of one fan blade of a fan in FIG. 2.

FIG. 3 is a side view of the fan structure in FIG. 1. FIG. 4 is a schematic view illustrating structure of one fan blade of a fan in FIG. 2. For clarity and ease of explanation, in FIG. 3, the side wall of a case 110 is omitted, only one fan blade 150 is shown, and other fan blades are also omitted.

Firstly, referring to FIGS. 1-4, in the present embodiment, a fan structure 100 is a centrifugal fan as an example and includes the case 110, a cover 120, and a fan 130. The cover 120 is disposed on the case 110, the cover 120 has an inlet 121, and the cover 120 and one side of the case 110 define an outlet 111. The fan 130 is pivotally disposed inside the case 110 and is located between the cover 120 and the case 110. When the fan 130 operates, an airflow is generated to enter the case 110 from the inlet 121 and flow out from the outlet 111.

To be more specific, the fan 130 includes a hub 140 and a plurality of fan blades 150, and the fan blades 150 are arranged around the periphery of the hub 140. In general, the hub 140 is coupled to a power source such as motor (not shown), and is driven by the power source to rotate about a rotation axis. At the same time, the fan blades 150 rotating along with the hub 140 can generate the airflow, in order to dissipate heat from the heat source. Each of the fan blades 150 includes an arc-shaped body 151 and a connecting portion 152, and the arc-shaped body 151 is connected with the connecting portion 152 and is connected to the hub 140 through the connecting portion 152. The fan blades 150 are metal fan blades as an example, and may be produced by die casting or stamping process or the like. In other words, the arc-shaped body 151 and the connecting portion 152 are integrally formed structure which has a better reliability.

In the present embodiment, the arc-shaped body 151 has a main portion 151*a* and an end portion 151*b* connected to the main portion 151*a*, the end portion 151*b* and the connecting portion 152 are respectively located at two opposite sides of the main portion 151*a*, and the width of the end portion 151*b* is gradually decreased in a direction D away from the main portion 151*a* and the hub 140. For example, the end portion 151*b*, in a direction parallel to the rotation axis of the fan 130, may have the first width W1 at a position relatively closer to the main portion 151*a* and the second width W2 at a position relatively further away from the main portion 151*a*, and the first width W1 is greater than the second width W2.

Furthermore, one side of the end portion 151*b* is obliquely extended downwards from the connecting portion between the end portion 151*b* and the main portion 151*a*, and thus a distance between that one side of the end portion 151*b* and an inner surface 122 of the cover 120 is gradually increased in the direction D away from the hub 140. For example, the distance between that side of the end portion 151*b* and the inner surface 122 of the cover 120 may be the first distance D1 at a position relatively closer to the hub 140 and may be the second distance D2 at a position relatively further away from the hub 140, and the first distance D1 is smaller than the second distance D2. Otherwise, another side of the end portion 151*b* is obliquely extended upwards from the connecting portion between the end portion 151*b* and the main portion 151*a*, and thus a distance between that another side of the end portion 151*b* and an inner surface 112 of the case 110 is gradually increased in the direction D away from the hub 140. For example, the distance between that another side of the end portion 151*b* and the inner surface 112 of the case 110 may be the third distance D3 at a position relatively closer to the hub 140 and may be the fourth distance D4 at a position relatively further away from the hub 140, and the third distance D3 is smaller than the fourth distance D4.

Based on the design for conflict prevention of the end portion 151*b* opposite to the hub 140 in each of the fan blades 150, the end portion 151*b* of the fan blade 150, which produces deviation, would not hit the inner surface 122 of the cover 120 and the inner surface 112 of the case 110 during the operation of the fan 130. As a result, the length of the fan blade 150 (also called as arc length of the fan blade 150) in the direction perpendicular to the rotation axis of the fan 130 may be increased, so as to significantly improve the heat dissipation efficiency of the fan 130 and, at the same time, to meet the thin design requirements.

In the present embodiment, the end portion 151*b* of each of the fan blades 150 is an arc-shaped structure, and a ratio of a length L1 (also called as arc length) of the main portion 151*a* to a length L2 of the end portion 151*b* (also called as arc length) is 6:1, but the disclosure is not limited thereto. In other embodiments, the end portion of the fan blade may be a triangular structure, trapezoidal structure, semicircular structure, semi-elliptical structure, or other polygonal structure. On the other hand, the ratio of the length of the main portion (also called as arc length) to the length of the end portion (also called as arc length) in the fan blade can be adjusted according to actual design requirements, or can be adjusted according to the deviation degree during the operation of the fan.

Another embodiment is described hereinafter. It should be noted, the embodiments below utilize component labels and partial content from the aforementioned embodiments, wherein identical or similar elements are labeled with identical labels, and therefore description of similar technical content will be omitted. The different features of each of the embodiments, basically, can be applied to other embodiments. Regarding the description of the omitted parts, reference may be made to the previous embodiment, and will not be repeated in the below embodiment.

Figure 5:
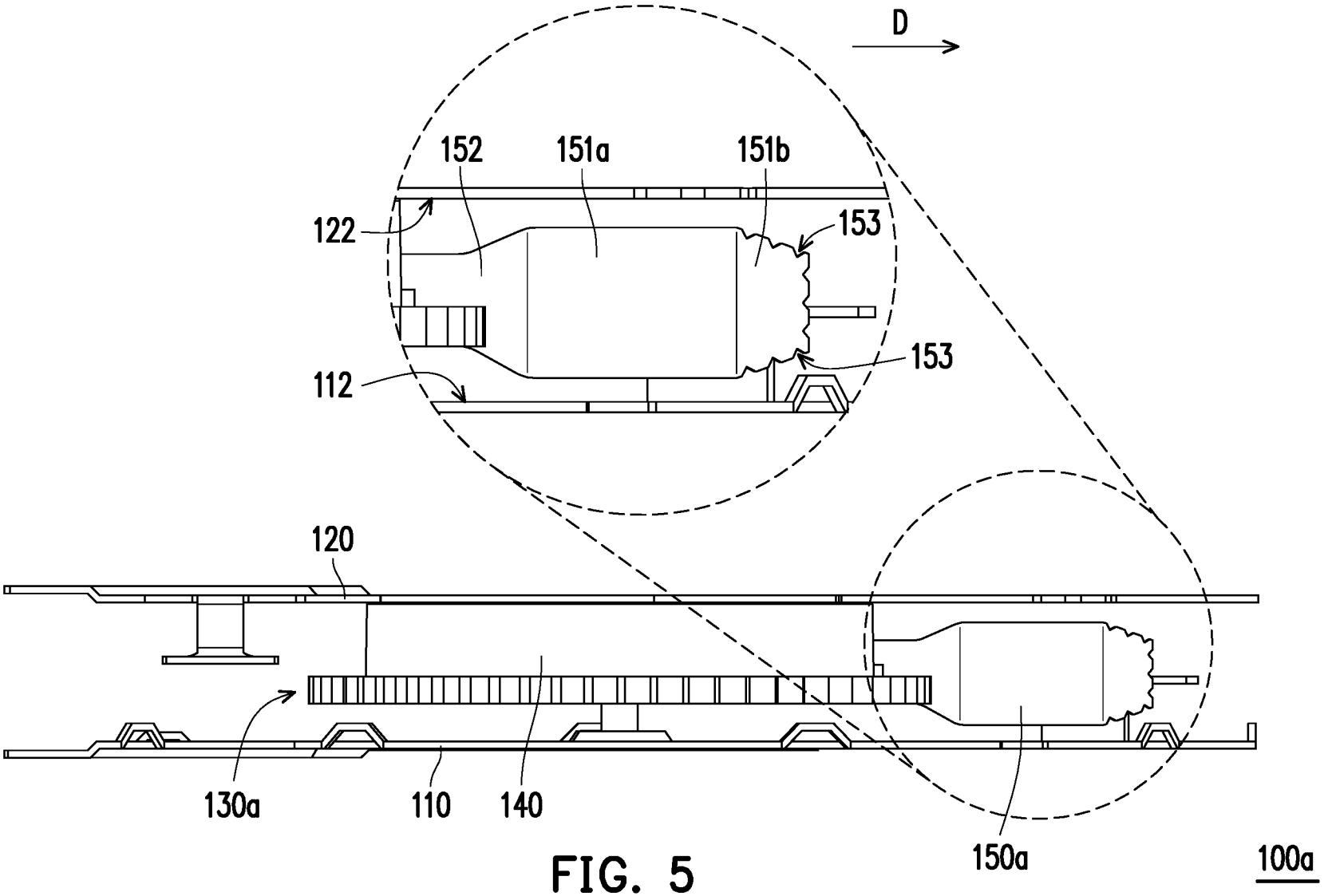
FIG. 5 is a side view of a fan structure according to another embodiment of the disclosure.
Figure 6:
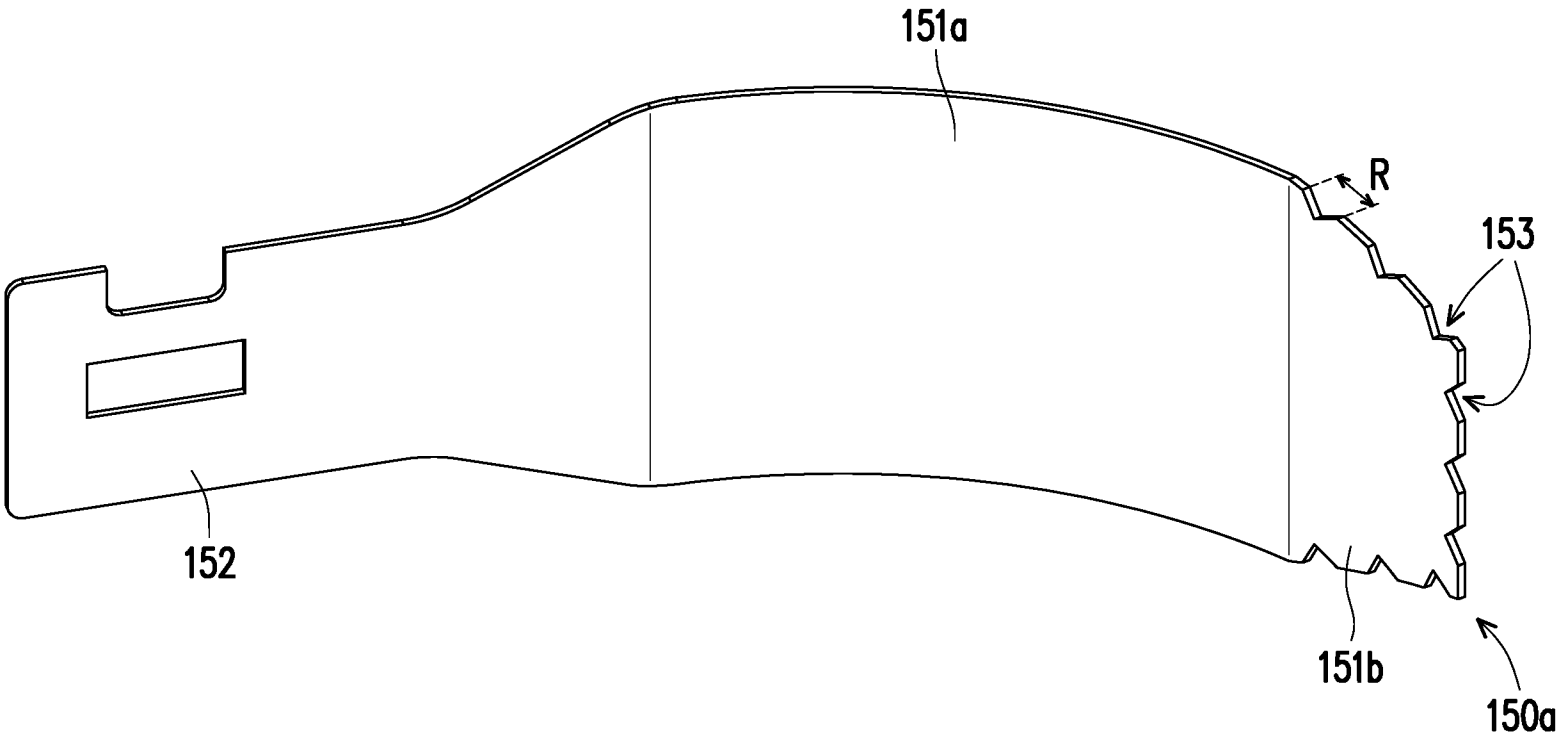
FIG. 6 is a schematic view illustrating structure of a fan blade in FIG. 5.

FIG. 5 is a side view of a fan structure according to another embodiment of the disclosure. FIG. 6 is a schematic view illustrating structure of a fan blade in FIG. 5. It should be noticed here, for clarity and ease of explanation, in FIG. 5, the side wall of the case 110 is omitted, only one fan blade 150*a* is shown, and other fan blades are also omitted. Referring to FIGS. 5 and 6, the fan structure 100*a* and the fan blade 150*a* of the fan structure 100*a* the present embodiment are substantially similar to the fan structure 100 and the fan blade 150 of the fan structure 100 of the first embodiment. The differences are that the periphery of the end portion 151*b* of the fan blade 150*a* is configured with a plurality of recesses 153, and the recesses 153 may be arranged a part of the periphery of the end portion 151*b* or may be arranged the whole periphery of the end portion 151*b*. An aperture R of each of the recesses 153 is between 0.1 mm and 0.5 mm. In other words, the diameter R is greater than or equal to 0.1 mm and is smaller than or equal to 0.5 mm. On the other hand, the recesses 153 may be semicircular recesses, semi-elliptical recesses, triangular recesses, trapezoidal recesses, or other polygonal recesses. Therefore, while the fan 130*a* operates, the airflow at the end portion 151*b* of the fan blade 150*a* can form vortex inside the recesses 153, so as to reduce energy or pressure carried by the end portion 151*b* of the fan blade 150*a*, thereby achieving the effect of reducing noise.

In summary, in the fan blade adopted by the fan structure of the disclosure, the end portion relative to the hub has a design for conflict prevention. Therefore, the end portion of the fan blade, which produces deviation, does not hit the cover and the case during the operation of the fan. As a result, the length of the fan blade (also called as arc length of the fan blade) in the direction perpendicular to the rotation axis of the fan may be increased, so as to significantly improve the heat dissipation efficiency of the fan and, at the same time, to meet the thin design requirements. On the other hand, the end portion of the fan blade may be configured with a plurality of recesses. Therefore, while the fan operates, the airflow at the end portion of the fan blade can form vortex inside the recesses, so as to reduce energy or pressure carried by the end portion of the fan blade, thereby achieving the effect of reducing noise.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A fan blade, comprising:

an arc-shaped body, having a main portion and an end portion connected to the main portion, wherein a width of the end portion is gradually decreased in a direction away from the main portion; and a connecting portion, connected to the main portion, wherein the end portion and the connecting portion are respectively located at two opposite sides of the main portion, the end portion has one side obliquely extending downwards in the direction away from the main portion and another side obliquely extending upwards in the direction away from the main portion, and the two sides of the end portion are configured with a plurality of recesses.

2. The fan blade as recited in claim 1, wherein the end portion is an arc-shaped structure.

3. The fan blade as recited in claim 1, wherein a diameter of each of the recesses is between 0.1 mm and 0.5 mm.

4. The fan blade as recited in claim 1, wherein a ratio of a length of the main portion to a length of the end portion is 6:1.

5. A fan structure, comprising:

a case;

a cover, disposed on the case; and a fan, pivotally disposed inside the case, and located between the cover and the case, the fan comprising:

a hub; and a plurality of fan blades, arranged around a periphery of the hub, and each of the fan blades comprising:

an arc-shaped body, having a main portion and an end portion connected to the main portion, wherein a width of the end portion is gradually decreased in a direction away from the main portion; and a connecting portion, connected to the main portion, wherein the end portion and the connecting portion are respectively located at two opposite sides of the main portion, and the main portion is connected to the hub through the connecting portion, the end portion has one side obliquely extending downwards in the direction away from the main portion and another side obliquely extending upwards in the direction away from the main portion, and the two sides of the end portion are configured with a plurality of recesses.

6. The fan structure as recited in claim 5, wherein the end portion of each of the fan blades is an arc-shaped structure.

7. The fan structure as recited in claim 5, wherein a diameter of each of the recesses of each of the fan blades is between 0.1 mm and 0.5 mm.

8. The fan structure as recited in claim 5, wherein a ratio of a length of the main portion to a length of the end portion of each of the fan blades is 6:1.

9. The fan structure as recited in claim 5, wherein a distance between the one side of the end portion of each of the fan blades and one inner surface of the cover is gradually increased in a direction away from the hub, and a distance between the another side of the end portion of each of the fan blades and another one inner surface of the case is gradually increased in the direction away from the hub.

* * * * *